US008899137B1

(12) United States Patent
Bride et al.

(10) Patent No.: US 8,899,137 B1
(45) Date of Patent: Dec. 2, 2014

(54) REMOTE JETTISON DISCONNECT SYSTEM FOR A MINE ROLLER

(71) Applicants: Dustin T. Bride, Panama City, FL (US); Daniel P. Coats, Panama City Beach, FL (US); Michael Conn, Panama City Beach, FL (US); Christopher J. Doyle, Panama City Beach, FL (US); John M. Gwyn, Panama City, FL (US)

(72) Inventors: Dustin T. Bride, Panama City, FL (US); Daniel P. Coats, Panama City Beach, FL (US); Michael Conn, Panama City Beach, FL (US); Christopher J. Doyle, Panama City Beach, FL (US); John M. Gwyn, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 84 days.

(21) Appl. No.: 13/888,990

(22) Filed: May 7, 2013

(51) Int. Cl.

| | |
|---|---|
| ***F41H 11/30*** | (2011.01) |
| ***F41H 11/12*** | (2011.01) |
| *F41H 11/16* | (2011.01) |
| *B63G 7/02* | (2006.01) |

(52) U.S. Cl.
CPC ..... *F41H 11/12* (2013.01); *F41H 11/16* (2013.01); *B63G 7/02* (2013.01)
USPC ..... 89/1.13; 102/402; 102/403

(58) Field of Classification Search
CPC ..... F41H 11/12; F41H 11/16; F41H 11/30; F41H 11/18; F41H 11/24; F41H 11/28; F41H 11/26; B63G 7/02; B63G 7/00; B63G 2007/005; F42D 5/04; F42C 15/42
USPC ..... 89/1.13; 102/402, 403
See application file for complete search history.

(56) References Cited

U.S. PATENT DOCUMENTS

| | | | | |
|---|---|---|---|---|
| 4,723,473 | A * | 2/1988 | Grinwald | 89/1.13 |
| 6,026,135 | A * | 2/2000 | McFee et al. | 376/159 |
| 6,333,631 | B1 * | 12/2001 | Das et al. | 324/326 |
| 6,619,177 | B1 * | 9/2003 | Hansen et al. | 89/1.13 |
| 2002/0017040 | A1 * | 2/2002 | French | 37/301 |

* cited by examiner

*Primary Examiner* — Joseph W Sanderson
(74) *Attorney, Agent, or Firm* — James T. Shepherd

(57) ABSTRACT

A remote jettison system is provided to disconnect a mine roller from a tactical vehicle. The system enables personnel conducting mine roller operations to disengage the vehicle from the mine roller without leaving the vehicle. The remote jettison system has two assemblies: A mine roller assembly and a tactical vehicle assembly. The mine roller assembly, which is connected to the mine roller, can be remotely disconnected from the tactical vehicle assembly, which is mounted on the vehicle. The system utilizes one mechanized latch to release the mine roller assembly from the tactical vehicle assembly, allowing the force of gravity to cause them to separate.

9 Claims, 5 Drawing Sheets

REMOTE JETTISON DISCONNECT SYSTEM FOR A MINE ROLLER

STATEMENT OF GOVERNMENT INTEREST

The invention described herein may be manufactured and used by or for the Government of the United States of America for Governmental purposes without the payment of any royalties.

BACKGROUND OF THE INVENTION

1. Field of the Invention

The present invention relates generally to mine rollers, and in particular to a system for remotely disconnecting a mine roller from a tactical vehicle.

2. Prior Art

Pushed mine rollers have historically been attached to the front of tactical vehicles, which are driven along a road surface or other areas suspected of containing mines or IEDs in order to prematurely detonate the mines before they can cause serious damage to the tactical vehicles and injure personnel. For example, the mine rollers have been mounted on M1 or M60 tanks modified with permanently attached mine roller mounting kits. Wheeled tactical vehicles, such as heavily modified Humvees, are more commonly used now, in part because they are lighter and more energy efficient.

Current mine rollers are typically released from the tactical vehicles by manually pulling two steel pins having cotter pins on either end to keep the pins retained in the pad-eyes of the mine roller system. The tongue load of the mine roller system (MRS) is applied to the pins, and a forklift or crane is often required to take off the tongue load as that the pins can be pulled manually, thereby disconnecting the MRS. Often, it is necessary to disconnect the MRS after a system failure or when the MRS is damaged by a mine or IED blast. This is especially troublesome during combat operations when personnel can be exposed to extreme danger while attempting to disconnect the MRS so they can evacuate the area in the vehicle. Thus, a need has been identified for a system that would allow operators to jettison the MRS from the vehicle remotely, e.g., from inside the vehicle, without exposing the operators to potentially dangerous enemy fire.

SUMMARY OF THE INVENTION

The invention is a remote jettison disconnect system (RJDS) for a mine roller. The typical mine roller has right and left arm pairs extending rearward from the mine roller for attaching to a tactical vehicle. The RJDS comprises two major assemblies: A mine roller assembly, which is attached to the arms of the mine roller; and a tactical vehicle assembly, which is attached to the tactical vehicle.

The mine roller assembly has an elongate strength member—typically a steel tube—with a pair of connection plates mounted thereon and spaced apart at a distance substantially equal to the center-to-center distance between the right and left arm pairs of the mine roller. The connection plates have through-plate apertures, and bolts are passed through the apertures and corresponding holes on the mine roller arm pairs to form a pivoting attachment of the mine roller to the connection plates.

The mine roller assembly has a pair of hitching plates mounted on the strength member at opposite ends thereof, a pair of J-hooking plates also mounted on opposite ends of the strength member, and a pair of dual function plates also mounted on the strength member at opposite ends. The hitching plates, J-hooking plates, and dual function plates all have rearward projecting sections with tapered arches that are sized and positioned to accept a pair of shafts installed on the tactical vehicle assembly, as discussed below. The arches of all six plats are laterally aligned with each other, i.e., the lateral centerlines of their arches are co-linear, so that they all will securely mount on the parallel co-linear pair of shafts on the tactical vehicle assembly when the RJDS is assembled Each dual function plate additionally has a rearward projecting upper section having a latch pin extending laterally therefrom for engagement with either a latch or a stop on corresponding plates on the tactical vehicle assembly.

The tactical vehicle assembly also has an elongate strength member—typically a steel tube—that is approximately the same length as the mine roller assembly strength member. Mounting plates are mounted on opposite ends of the strength member and have rearward projecting sections with mounting holes for mounting the strength member to corresponding support brackets on the tactical vehicle. A pair of shaft mounting plates are mounted on opposite ends of the strength member and have forward projections with horizontal through-plate apertures to accept corresponding parallel shafts.

A tetra-function plate is mounted on one end of the tactical vehicle assembly strength member. The tetra-function plate has a sloped inward curved inversion on its forward edge that forms a stop for accepting one of the latch pins on the mine roller assembly dual function plates. The tetra-function plate also has a horizontal through-plate aperture for accepting a corresponding shaft.

A latching assembly is mounted to the tactical vehicle strength member on the end opposite from the end where the tetra-function plate is mounted. The latching assembly has a modified shaft plate mounted to the strength member. The modified shaft plate has a horizontal through-plate aperture to accept one of the shafts. An actuator mounting panel is mounted on the modified shaft plate and has a latch inversion similarly sized and laterally aligned with the curved inversion of the tetra-function plate to accept the other latch pin.

A geared inverted plate is rotatably mounted to the actuator mounting panel adjacent to the latch inversion. The geared inverted plate has a finger-like extension which covers/closes the entrance to the latch inversion (and locks the latch pin in place when the system is assembled) when the geared inverted plate is rotated in one direction, and opens the entrance to the latch inversion (allows insertion of or releases the latch pin) when the geared inverted plate is rotated in the other direction.

A wheel gear is also rotatably mounted to the actuator mounting panel so that its gear teeth engage the gear teeth of the geared inverted plate. An electric actuator is coupled to the wheel gear and causes the wheel gear to rotate in response to electrical signals from a remote control box, thereby causing the geared inverted plate to rotate and its finger-like extension to retain/release the latch pin from the latch inversion.

As referred to above, the pair of shafts are inserted into apertures in corresponding plates. Specifically, the first shaft passes through and is retained in the apertures in the forward projecting sections of the tetra-function plate and an adjacent shaft mounting plate; the second shaft passes through and is retained in the apertures in the forward projecting sections of the modified shaft plate and the other shaft mounting plate. When installed, the shafts are substantially parallel to each other and to the strength members, and they are substantially co-linear. Each of the shafts has an inboard flange and an outboard flange to retain the shafts in the apertures. Each shaft also preferably has a covering sleeve that reduces friction and wear on the shaft.

Typically, the remote control box is located within the tactical vehicle so that personnel can operate it, and, thus, control the electric actuator without exiting the vehicle to release the latch pin, thereby allowing the mine roller assembly (and an attached mine roller) to drop away from the tactical vehicle assembly under the force of gravity. In an exemplary embodiment, the remote control box is hard-wired to an electrical box which passes the control signals from the remote control box to the actuator. The electrical box also distributes electrical power from the vehicle to the actuator and also to electrical equipment on the mine roller.

When the RJDS is assembled, the laterally aligned tapered arches on the hitching plates, J-hooking plates, and dual function plates of the mine roller assembly engage and rest upon the shafts installed on the tactical vehicle assembly. One of the latch pins on a dual function plate on the mine roller assembly enters and abuts the stop formed by the sloped inward curved inversion of the tetra-function plate on the tactical vehicle assembly. The other latch pin enters the latch inversion of the actuator mounting panel, and is held therein by the finger-like extension when the curved geared plate is rotated to the closed position by the actuator.

BRIEF DESCRIPTION OF THE DRAWINGS

The invention will become readily apparent by referring to the following detailed description and the appended drawings in which.

DETAILED DESCRIPTION OF THE INVENTION

Figure 1:
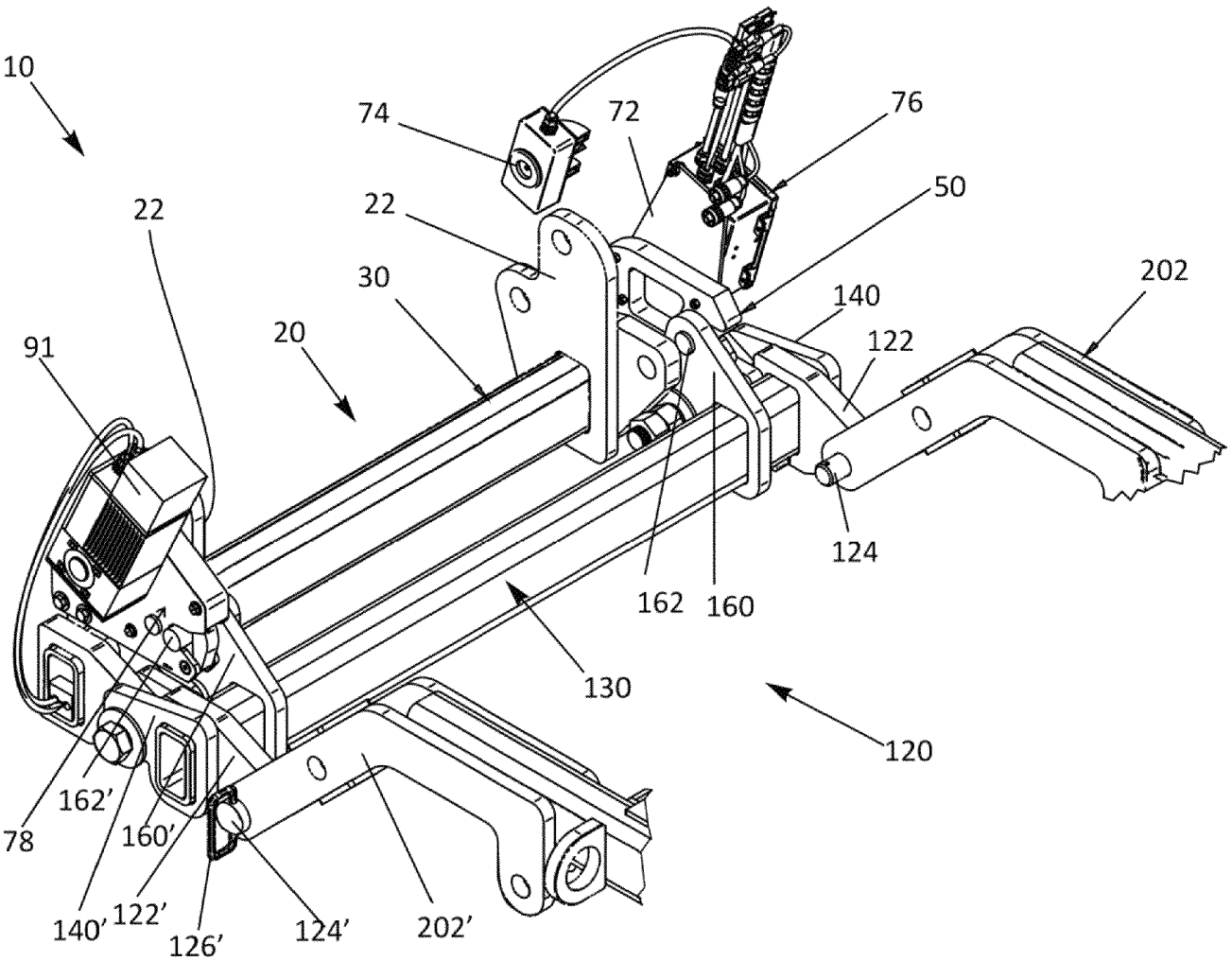
FIG. 1 is an elevated perspective view of the remote jettison disconnect system for a mine roller that includes a mine roller assembly connected to a tactical vehicle assembly, where only a portion of the mine roller is shown.
Figure 3A:
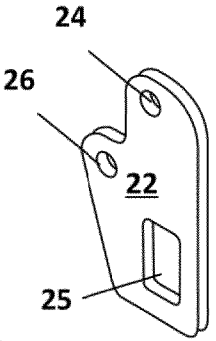
FIG. 3*a* is an enlarged view of the tactical vehicle mounting plate shown in FIG. 3.

The invented remote jettison disconnect system (RJDS) provides in-cab release of a mine roller mounted to a tactical vehicle, thus eliminating the need for personnel to exit the vehicle and be exposed to hazardous conditions while disconnecting the mine roller. The system 10, as shown in FIG. 1, includes two assemblies: A tactical vehicle assembly 20 and a mine roller assembly 120. In FIG. 1 the assemblies 20,120 are connected. The tactical vehicle assembly 20 is shown in greater detail in FIG. 3. The tactical vehicle assembly 20 is mounted to a strength member front bumper 100 using at least two pairs of support brackets 102,104. Holes 106 are for head lamps (not shown). The illustrated support brackets are mounted on the front 102 and the bottom 104 of the front bumper 100, and are aligned to be mated to a pair of tactical vehicle mounting plates 22 on tactical vehicle assembly 20. Each tactical vehicle mounting plate 22 has an upper rear mounting hole 24 and lower rear mounting hole 26 for attaching the vehicle mounting plate 22 to bumper 100, as shown in FIG. 3*a*. The tactical vehicle mounting plate 22 has a mounting opening 25, where the perimeter of the mounting opening 25 is welded to the tactical vehicle elongate strength member 30 at a location several inches from each end 32.

In the exemplary embodiment illustrated and described herein, the tactical vehicle elongate strength member 30 is a rectangular steel tube that is about three inches by about five inches, having walls with a nominal thickness of about three eighths of an inch.

Figure 3B:
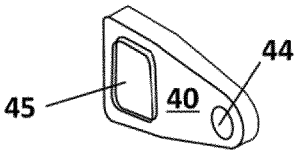
FIG. 3*b* is an enlarged view of the shaft mounting plate shown in FIG. 3.

Adjacent to and outboard of each tactical vehicle mounting plate 22 is a shaft mounting plate 40. Each shaft mounting plate 40 is mounted on the tactical vehicle elongate strength member 30, projecting forward, substantially horizontal to the ground. As shown in FIG. 3*b*, each shaft mounting plate 40 has a mounting opening 45, where the perimeter of the mounting opening 45 is welded to the tactical vehicle elongate strength member 30. The shaft mounting plate 40 has a forward projection 42 with a horizontal through-plate aperture 44 for receiving and supporting a segment of a shaft 60.

Adjacent to and outboard of the left tactical vehicle shaft mounting plate 40 is a tetra-function plate 50. Each tetra-function plate 50 has an open base 52 for mounting on the tactical vehicle elongate strength member 30. Typically, the open base 52 is U-shaped so that the tetra-function plate 50 can drop down on the rectangular tube shaped steel beam 30. The tetra-function plate is secured with a base plate 57 that fastens the tetra-function plate to the tactical vehicle elongate strength member 30. An upper front edge portion 53 of the tetra-function plate 50 curves upward. A lower front edge portion 54 curves downward, forming a sloped inward curved inversion 56 with an open forward portion. The inversion 56 functions as a stop for the outward depending heavy duty latch pin 162 on a dual function plate 160 on the mine roller assembly 120. A lower front edge portion 58 of the tetra-function plate 50 has a through-plate aperture 59 for receiving and supporting a shaft 60. The middle 55 and upper 51 portions of the tetra-function plate 50 are normally used to mount an electrical box mounting plate 72 (see FIG. 1).

The electrical box mounting plate 72 supports the electrical box 76 which is in communication with the remote control box 74 and the actuator 91. The control box 74 is typically located inside the cab of the tactical vehicle (not shown for clarity of illustration) and controls the actuator 91, via connections with the electrical box 76, to provide in-cab release of the mine roller assembly, thus eliminating the need for personnel to exit the tactical vehicle. The electrical box 76 effectively functions as a junction bow. It receives power from the tactical vehicle, distributes power to the actuator 91 as well as to the electronics on the mine roller itself, and distributes signals between the control box 74 and actuator 91.

Figure 5:
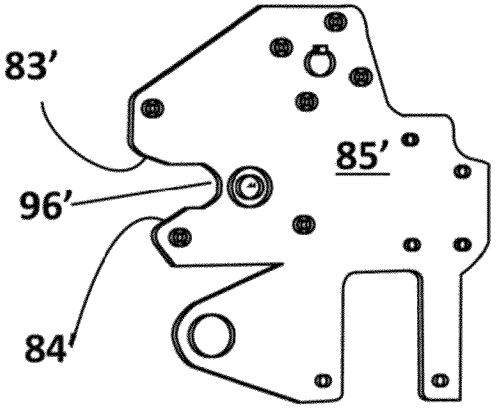
FIG. 5 is a side view of left side panel that covers components mounted on the actuator mounting panel.
Figure 4:
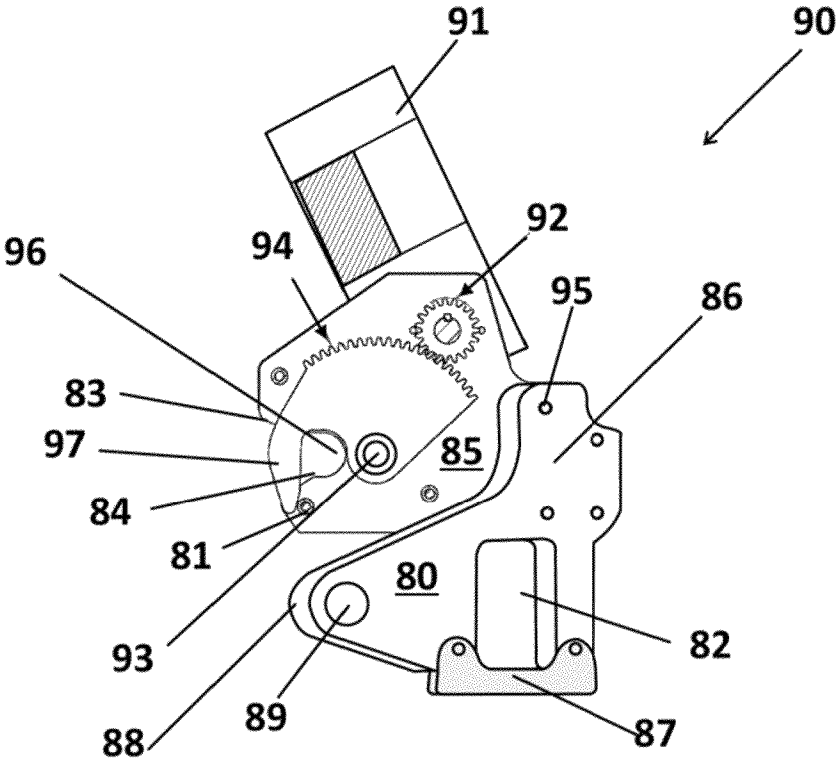
FIG. 4 is a left side view of a latch mounted on the right side or the tactical vehicle assembly, where a left side panel is removed, therein illustrating an actuator mounted on an actuator mounting plate that is mounted on a modified shaft plate with a base plate, wherein the actuator mounting plate has a geared curved plate mounted with a curved finger-like projection that controls passage through the entrance of the sloped inward curved inversion on the actuator mounting plate.

As shown in FIG. 1, FIG. 4 and FIG. 5, a latching assembly 90 is mounted on the right side of the tactical vehicle assembly 20. An actuator 91 for mechanized operation of a latch 97 is mounted on an actuator mounting panel 85, which is mounted to an upper portion 86 of a modified shaft plate 80 with a base plate 87. The modified shaft plate 80 has an open base 82 for mounting on the tactical vehicle elongate strength member 30. Typically, the open base 82 is U-shaped so that the modified shaft plate 90 can drop down on the rectangular tube shaped steel beam 30. The modified shaft plate 80 is secured with the base plate 87. In FIG. 4 a protective left side panel 85' (illustrated in FIG. 5) is removed. The actuator 91 can open or close a finger-like extension 97 of a geared curved plate 94 rotating on axle 93. The geared curved plate 94 is rotated by engaged wheel gear 92 to control movement of the finger-like extension into or out of the latch inversion 96 on panel 85 and latch inversion 96' on plate 85'. The inversion is substantially parallel to a segment of the shaft 60.

The shaft 60 is supported by a lower portion 88 of the modified shaft plate 80 having a through-plate aperture 89 for receiving and supporting the shaft. An entering upper portion 83 of panel 85 of inversion 96 is curved and sloped upward and lower portion 84 is curved and sloped downward. Similarly, an entering upper portion 83' of plate 85' of inversion 96' is curved and sloped upward and lower portion 84' is curved and sloped downward. The combined effect is that when the finger-like extension 97 is closed, resting on a stop bolt 81, the latch pin 162' of mine roller assembly 120 will be snugly held by the latch 97. When the finger-like extension 97 is retracted, the latch pin 162', under the gravitational force of the tongue pressure of the mine roller, will rotate and be jettisoned from the latch.

Figure 2:
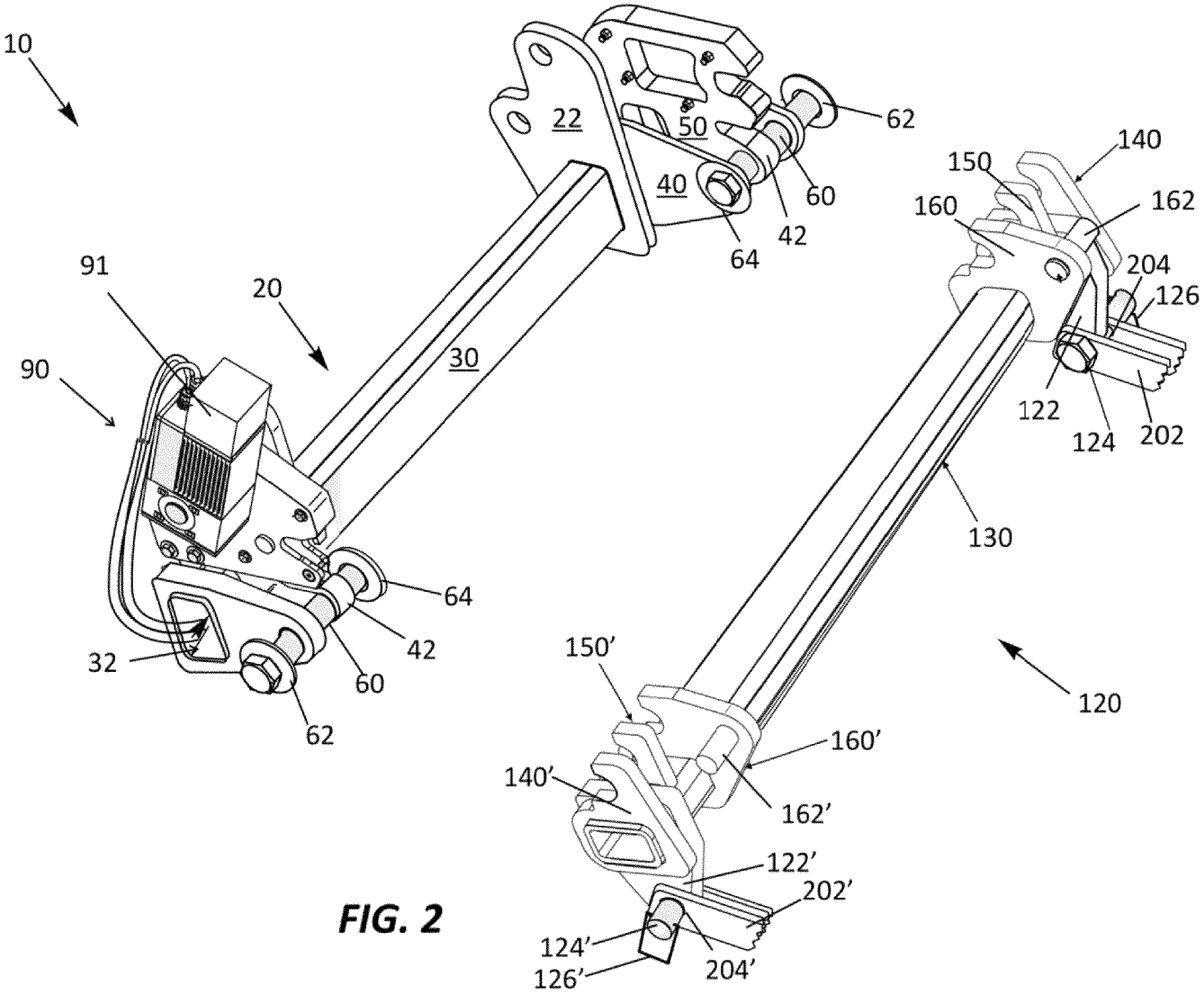
FIG. 2 is an elevated perspective view of the mine roller assembly disconnected from the tactical vehicle assembly, where most of the electrical wiring components are not shown.
Figure 3C:
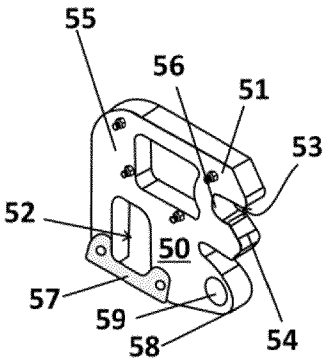
FIG. 3*c* is an enlarged view of the tetra-function plate shown in FIG. 3.
Figure 3:
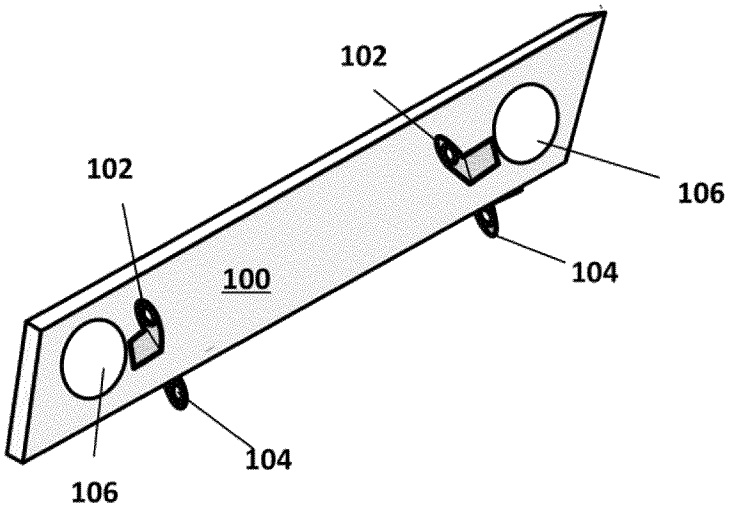
FIG. 3 is an elevated perspective view illustrating the tactical vehicle assembly and a strength member front bumper of the tactical vehicle used to push the mine roller.
Figure 3:
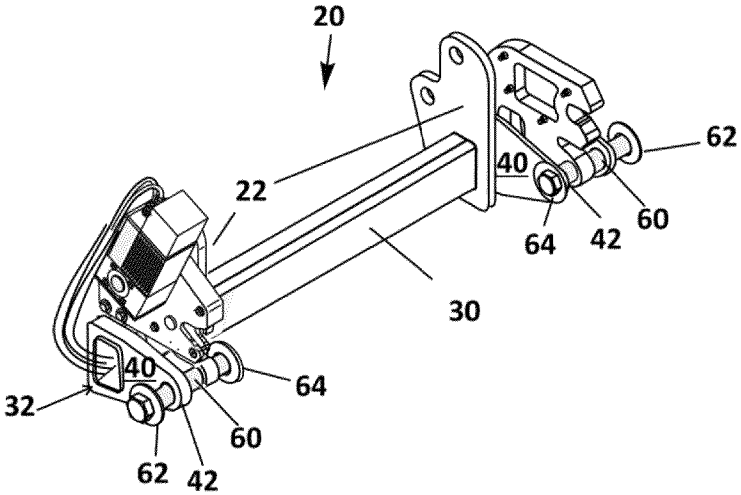

Each shaft 60, as shown in FIG. 2 and FIG. 3 can be fitted with a sleeve 61, such as a tough low friction plastic or metal, where the sleeve reduces wear of the shaft. Each sleeve 61 has an in-board flange 64 and an out-board flange 62, where the flanges function as lateral stops to limit movement of hitched elements.

In FIG. 2 the mine roller assembly 120 is shown disconnected from the tactical vehicle assembly. The mine roller assembly 120 is pivotally fastened to a left pair of arms 202 and a right pair of arms 202' of a mine roller (only the arms are shown), where both pairs of arms are equally spaced and parallel, and both pairs have opposing pairs of connection holes 204,204'. Each pair of arms is connected to a connection plate 122,122' on the mine roller assembly using a heavy duty bolt 124,124'. Each bolt preferably has a handle 126,126', to help remove the bolt. The junction of the connection plates 122,122' and the pairs of arms 202,202' is a pivot point. The mine roller assembly 120 rocks back and drops when it is jettisoned, i.e., when the latch pin 162' is released by the finger-like extension 97 of the latching assembly 90. The heavy duty bolts 124,124' can be utilized as emergency or backup release points for separating the RJDS and the tactical vehicle from the mine roller when the remote jettison system is inoperable or otherwise not used.

Figure 6C:
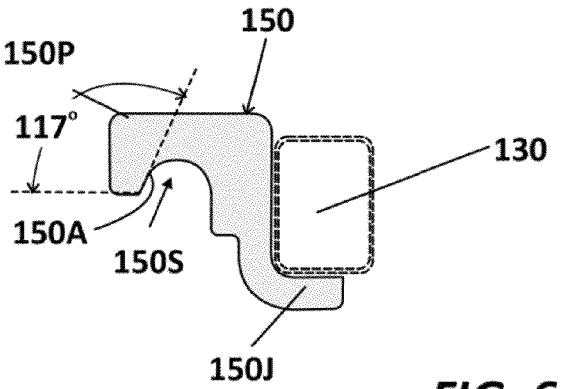
FIG. 6*c* is a detail view of a J-hooking plate of the mine roller assembly illustrated in FIG. 2.
Figure 6D:
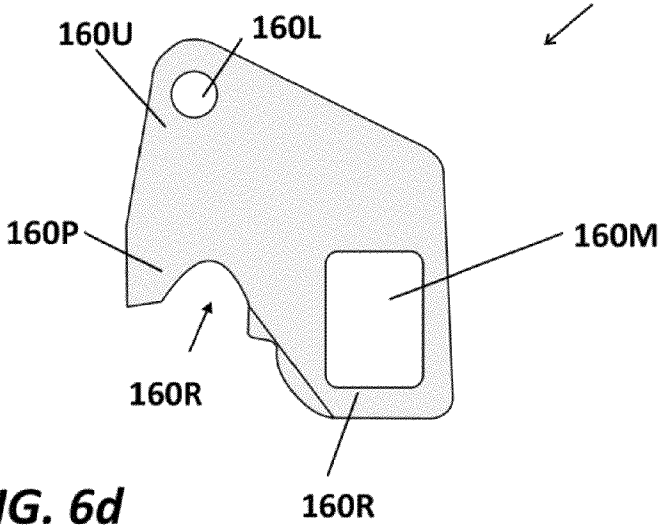
FIG. 6*d*is a detail view of a dual function plate of the mine roller assembly illustrated in FIG. 2.
Figure 6B:
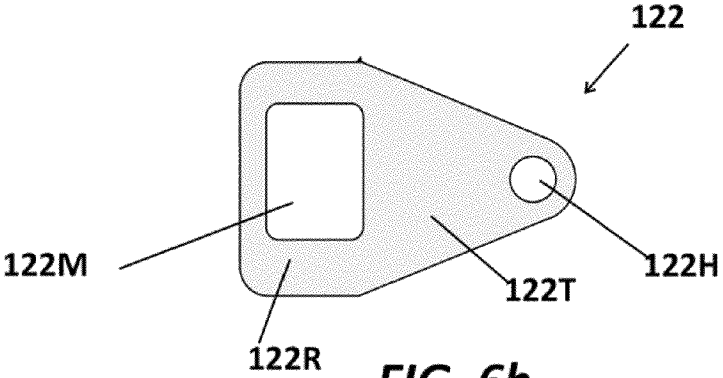
FIG. 6*b* is a detail view of a connection plate of the mine roller assembly illustrated in FIG. 2.

As illustrated in FIG. 2, the connection plates 122,122' are mounted near the ends of a mine roller assembly elongate strength member 130. As shown in FIG. 6*b*, each connection plate 122,122' has a roughly rectangular section 122R with a mounting opening 122M, and a triangular section 122T with a through-plate aperture 122H, where the through-plate aperture 122H can accommodate a heavy duty bolt 124,124'. The perimeter of the mounting opening 122M is welded to the elongate strength member 130 of mine roller assembly 120.

In the exemplary embodiment, the elongate strength member 130 is a rectangular steel tube that is about three inches by about five inches, having a nominal wall thickness of about three eights of an inch. The elongate strength member 130 is at least as long as the distance separating the left pair of arms 202 and the right pair of arms 202'.

Figure 6A:
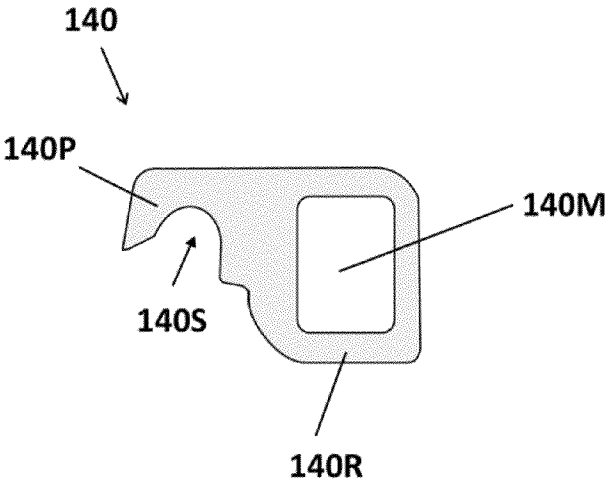
FIG. 6*a* is a detail view of a hitching plate of the mine roller assembly illustrated in FIG. 2.

Each of the connection plates 122,122' are flanked outboard by hitching plates 140,140', respectively. Each hitching plate 140,140' is mounted to the elongate strength member 130, such that a hitching projection section 140P (see FIG. 6*a*) of the plate projects substantially opposing the triangular section 122T of the connection plate 122. As shown in FIG. 6*a*, hitching plate 140 has a rectangular section 140R with a mounting opening 140M, wherein a perimeter of the mounting opening 140M is welded to the mine roller assembly's elongate strength member 130. The hitching projection section 140P is a thick arched projection with a tapered arch 140S that can hitch on an outboard segment of a shaft 60 on the tactical vehicle assembly 20.

Each of the connection plates 122,122' are also preferably flanked in-board by J-hooking plates 150,150', respectively. Each J-Hooking plate 150,150' is welded to the elongate strength member 130 (shown in ghost with dashed lines in FIG. 6*c*), such that a hitching projection section 150P of the plate projects substantially opposing the triangular section 122T of the connection plate 122. As shown in FIG. 6*c*, J-hooking plate 150 has a "J" section 150J with a length that follows the contour of the elongate strength member 130, wherein a portion of the length of the J-section 150J is welded to the elongate strength member 130. The hitching projection section 150P is a thick arched projection with a tapered arch 150S that can hitch on an inboard segment of a shaft 60 on the tactical vehicle assembly 20. In the exemplary embodiment, the arc 150A is about 153 degrees (180−117+90=153) with a range of plus ten to minus ten degrees, and then the arc opens into a linear slope. The J-hooking plate 150 keeps lateral movement of the mine roller assembly 120 to a minimum as each connection plate 122 is sandwiched between a J-hooking plate 150 and a hitching plate 140.

In addition to the hitching plates 140' and the J-hooking plates 150' proximate to the right end of the mine roller elongate strength member 130, and the hitching plate 140 and the J-hooking plates 150 proximate to the left end of the mine roller elongate strength member 130, there is a pair of dual function plates 160,160' located inboard of J-hooking plates 150,150', respectively. As identified in FIG. 6*d* each dual function plate 160,160' has a latch projection 160U with an opening 160L for outward depending heavy duty latch pin 162,162' (see FIG. 2) and a hitching projection 160P that has a thick recessed tapered arch 160S that can hitch on another inboard segment of a shaft 60 on the tactical vehicle assembly 20. The left and right dual function plates 160,160' are substantially mirror images, the only difference being that on one side, for example the right side, the right heavy duty latch pin 162' (see FIG. 2) will be engaged by the mechanized latch 90 (see FIG. 4) on the tactical vehicle assembly 20, while on the left side the left heavy duty latch pin 162 will come into contact with a stop 56 (sloped portion 56 of tetra-function plate 50, see FIG. 3*c*) on the left side of the tactical vehicle assembly 20. The mechanized latch can be opened remotely, for instance from the cab of the tactical vehicle. Each dual function plate 160,160' has a rectangular section 160R with a mounting opening 160M, where a perimeter of the mounting opening is welded to the mine roller elongate strength member 130. The heavy duty latch pins 162,162' are substantially parallel to the mine roller elongate strength member 130.

In the hitched position, the latch is closed, and the elongate strength members on both assemblies are about at the same height and the heavy duty latch pins 162,162' are substantially parallel and directly above the corresponding shaft 60 on the tactical vehicle assembly 20. When latched, the mine roller assembly has a fixed position, and unlike a ball hitch where there can be wide horizontal rotational movement and some vertical rotational movement, all movement is locked out. The only movement that is allowed is at the pivot point between the mine roller assembly and the left pair of arms 202 and the right pair of arms 202', where both pairs of arms are equally spaced and parallel, and both pairs have opposing pairs of connection holes 204,204' that function substantially as horizontal bearings. Each pair of arms 202,202' is connected to a corresponding connection plate 122,122' on the mine roller assembly 120 using a heavy duty axle bolt 124, 124' that can be secured, for example with an axial pin having a handle 126,126' that permits vertical rotational movement of the mine roller.

When assembled and in operation, the tactical vehicle assembly 20 is typically mounted to the front of a tactical vehicle by mounting plates 22,22' so that the strength member 30 and shafts 60 are substantially parallel to the ground surface. The mine roller assembly 120 is attached to the tactical vehicle assembly 20 by placing the tapered arches 140S, 150S and 160S of the hitching plates 140,140', J-hooking plates 150,150' and dual function plates 160,160', respectively, over corresponding exposed portions of the shafts 60.

When the mine roller assembly 120 is rotated and positioned so that the plates 140,140', 150,150', 160,160' are substantially parallel to the ground and the tapered arches 140S, 150S, and 160S are facing downward, the shafts 60 support the weight of the mine roller assembly. Also when the mine roller assembly 120 is in this position, latch pin 162 is disposed within and abuts against the stop of inversion 56 of the tetra-function plate 50 and the other latch pin 162' is disposed within latch inversion 96 of the latching assembly 90.

When an operator activates the actuator 91 via remote control 74 to rotate geared curved plate 94 so that the finger-like extension 97 moves into the closed position (as illustrated in FIG. 4), the latch pin 162' is retained in that position, thereby retaining the mine roller assembly 120 in this position. The mine roller assembly 120 can be attached to the mine roller arm pairs 202,202' with bolts 124,124' either before or after it is attached to the tactical vehicle assembly 20.

When it becomes necessary to release the mine roller—and the attached mine roller assembly 120—from the tactical vehicle, the operator simply uses the remote control 74 to activate the actuator 81 to rotate the geared curved plate 94 so that the finger-like extension 97 moves into the open position (i.e., so that it does not block the entrance of latch inversion 96). When this occurs, latch pin 162' is released, allowing the mine roller assembly 120 to rotate and pivot about the bolts 124,124' and the shafts 60 so that the plates 140,140', 150, 150', and 160,160' can rotate downward under the influence of the tongue weight of the mine roller into a substantially vertical position and the tapered arches 140S, 150S, and 160S can fall away from the shafts 60, thereby releasing the mine roller assembly 120 from the tactical vehicle assembly. Thus unencumbered by the mine roller, the tactical vehicle can evacuate the area, for example in an emergency situation.

It is to be understood that the foregoing description and specific embodiments are merely illustrative of the best mode of the invention and the principles thereof, and that various modifications and additions may be made to the invention by those skilled in the art without departing from the spirit and scope of this invention. For example, the elongate strength members can be other than rectangular tubes and can be made of a material other than steel. Additional plates can be added to the strength members to provide additional supporting structure, or one or more of the disclosed plates, such as the J-hooking plate, may be omitted to save weight as long as there is sufficient supporting structure to support the weight of the mine roller and maintain the mine roller assembly's position and attachment to the tactical vehicle assembly.

What is claimed is:

1. A remote jettison system for a mine roller having left and right arm pairs for mounting to a vehicle, comprising:

a first shaft and a second shaft, each said first and second shaft having an inboard flange and an outboard flange;

a mine roller assembly comprised of an elongate first strength member having a length at least as long as the distance between the left and right arm pairs of the mine roller, first and second connection plates mounted on opposite ends of said first strength member at a separation distance substantially equal to the center-to-center distance between the left and right arm pairs, each said connection plate having a forward projecting section with a through-plate aperture, enabling a pivoting attachment to one of the pair of connecting paired parallel arms, first and second hitching plates mounted on opposite ends of said first strength member, each said hitching plate having a rearward projecting section with a tapered arch positioned and sized to accept a corresponding one of said first and second shafts when said shaft is positioned to be parallel to said first strength member, and first and second dual function plates mounted on opposite ends of said first strength member, each dual function plate having a rearward projecting lower section with a tapered arch that is substantially the same size as and aligned with said tapered arch of said hitching plates to accept a corresponding one of said first and second shafts, and having a rearward projecting upper section with a latch pin extending therefrom wherein each said latch pin is substantially parallel to said first strength member;

a tactical vehicle assembly comprised of an elongate second strength member having first and second ends, first and second mounting plates mounted on said first and second ends of said second strength member, each said mounting plate having a rearward projecting section with at least one mounting hole configured to attach said mounting plate to support brackets on the vehicle, first and second shaft mounting plates mounted on said first and second ends of said second strength member, each shaft mounting plate having a forward projection with a horizontal through-plate aperture sized to accept a corresponding one of said first and second shafts, and a tetra-function plate mounted on said first end of said second strength member, said tetra-function plate having a sloped inward curved inversion forming a stop on a forward edge thereof and configured to accept said latch pin on said first dual function plate, and said tetra-function plate also having a horizontal through-plate aperture sized to accept said first shaft;

a latching assembly comprised of a modified shaft plate mounted on said second end of said second strength member and having a horizontal through-plate aperture sized to accept said second shaft, an actuator mounting panel mounted on said modified shaft plate and having a latch inversion on a forward edge thereof, said latch inversion having an entrance and being configured to accept said latch pin on said second dual function plate, an actuator mounted on said actuator mounting panel, a wheel gear coupled to said actuator and rotatably mounted to said actuator mounting panel, and a geared inverted plate rotatably mounted to said actuator mounting panel and engaged by said wheeled gear, said geared inverted plate having a finger-like extension which closes said entrance of said latch inversion when said geared inverted plate is rotated in a first direction and opens said entrance of said latch inversion when said geared inverted plate is rotated in a second direction; and a remote control electrically coupled to said actuator for actuating said actuator remotely, thereby causing said geared inverted plate to rotate and causing said finger-like extension to release or retain said latch pin on said dual function plate from or in said latch inversion;

wherein, when the remote jettison system is assembled, said first shaft passes through and is retained in said through-plate aperture in said first shaft mounting plate and said through-plate aperture in said tetra-function plate and is positioned within said tapered arches of said first hitching plate and said first dual function plate, said second shaft passes through and is retained in said through-plate aperture opening in said second shaft mounting plate and said through-plate aperture in said modified shaft plate and is positioned within said tapered arches of said second hitching plate and said second dual function plate, said latch pin on said first dual function plate is positioned within said sloped inward curved inversion of said tetra-function plate, said latch pin on said second dual function plate is positioned within said latch inversion of said actuator mounting panel and releasably retained therein by said finger-like projection, and said latch pins, said first shaft, said second shaft, said first strength member and said second strength member are substantially parallel.

2. The remote jettison system according to claim 1, wherein said first and second strength members are rectangular steel tubes.

3. The remote jettison system according to claim 2, wherein said steel tubes are substantially three inches by five inches with nominal wall thicknesses of three eighths of an inch.

4. The remote jettison system according to claim 1, wherein said first and second strength members are substantially the same length.

5. The remote jettison system according to claim 2, wherein said first and second strength members are substantially the same length.

6. The remote jettison system according to claim 1, wherein each said shaft has a friction-reducing and wear-resistant sleeve.

7. A remote jettison system according to claim 1, further comprising first and second bolts configured to pass through said through-plate apertures in said first and second connection plates, respectively, and through corresponding holes in the left and right arm pairs of the mine roller to rotatably attach said connection plates thereto, each said bolt having a handle.

8. The remote jettison system according to claim 1, wherein said mine roller assembly further comprises first and second J-hooking plates mounted on opposite ends of said first strength member, each said J-hooking plate having a tapered arch that is substantially the same size as and aligned with said tapered arches of said hitching plates and said dual function plates to accept a corresponding one of said first and second shafts.

9. A remote jettison system according to claim 1, further comprising an electrical box mounting plate mounted to said tetra-function plate, and an electrical box mounted to said electrical box mounting plate, said electrical box being configured to distribute power from the vehicle to the mine roller and said actuator, and to distribute signals from said remote control to said actuator.

* * * * *